US011450278B2

(12) United States Patent
Iwauchi et al.

(10) Patent No.: US 11,450,278 B2
(45) Date of Patent: Sep. 20, 2022

(54) DISPLAY DEVICE AND DISPLAY DEVICE DRIVING METHOD

(71) Applicant: JOLED INC., Tokyo (JP)

(72) Inventors: Eiji Iwauchi, Tokyo (JP); Kazuki Sawa, Tokyo (JP); Kazuhiro Yoneda, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/466,154

(22) Filed: Sep. 3, 2021

(65) Prior Publication Data

US 2022/0076626 A1 Mar. 10, 2022

(30) Foreign Application Priority Data

Sep. 9, 2020 (JP) ..... JP2020-151350

(51) Int. Cl.
*G09G 3/3233* (2016.01)

(52) U.S. Cl.
CPC ... *G09G 3/3233* (2013.01); *G09G 2300/0819* (2013.01); *G09G 2320/0233* (2013.01);
(Continued)

(58) Field of Classification Search
CPC ..... G09G 3/3233; G09G 2300/0819; G09G 2320/0233; G09G 2320/0271;
(Continued)

(56) References Cited

U.S. PATENT DOCUMENTS

2005/0024546 A1 2/2005 Kubo et al.
2011/0169802 A1* 7/2011 Yamashita ..... G09G 3/3291 345/211
(Continued)

FOREIGN PATENT DOCUMENTS

JP 2005-055880 3/2005
JP 2016-109939 6/2016

OTHER PUBLICATIONS

Extended European Search Report (EESR) from European Patent Office (EPO) in European Patent Application No. 21194566.2, dated Feb. 8, 2022.

*Primary Examiner* — Tom V Sheng
(74) *Attorney, Agent, or Firm* — Greenblum & Bernstein, P.L.C.

(57) ABSTRACT

A display device includes: a luminance converter which converts input gradation value into a corresponding target luminance value; a luminance correction calculator which calculates output gradation value from the target luminance value using efficiency residual ratio representing a deterioration degree of a light-emitting element, and calculates a corrected luminance value therefrom; a current stress calculator which converts current stress amount on a light-emitting element calculated from the corrected luminance value into current stress amount when first reference current flows through the light-emitting element, and accumulates this to calculate an accumulated first stress amount; a CB stress calculator which converts CB stress amount on the light-emitting element into current stress amount when second reference current flows through the light-emitting element, and accumulates this to calculate an accumulated second stress amount; and an efficiency residual ratio calculator which updates the efficiency residual ratio, using the accumulated first and second stress amounts calculated.

8 Claims, 14 Drawing Sheets

(52) U.S. Cl.
CPC ..... *G09G 2320/0271* (2013.01); *G09G 2320/043* (2013.01); *G09G 2320/045* (2013.01); *G09G 2320/046* (2013.01); *G09G 2320/048* (2013.01)

(58) Field of Classification Search
CPC ..... G09G 2320/043; G09G 2320/045; G09G 2320/046; G09G 2320/048
USPC ..... 345/690
See application file for complete search history.

(56) References Cited

U.S. PATENT DOCUMENTS

| | | | | |
|---|---|---|---|---|
| 2012/0162280 | A1* | 6/2012 | Yamashita | G09G 3/3258 345/690 |
| 2022/0068204 | A1* | 3/2022 | Iwauchi | G09G 3/3233 |

* cited by examiner

DISPLAY DEVICE AND DISPLAY DEVICE DRIVING METHOD

CROSS REFERENCE TO RELATED APPLICATION

The present application is based on and claims priority of Japanese Patent Application No. 2020-151350 filed on Sep. 9, 2020. The entire disclosure of the above-identified application, including the specification, drawings and claims is incorporated herein by reference in its entirety.

FIELD

The present disclosure relates to display devices and display device driving methods.

BACKGROUND

It is known that, in luminescent elements such as organic electroluminescent (EL) elements, the light-emitting layer included in the luminescent element deteriorates according to the light-emission amount, the light-emission time (duration), and the temperature.

When luminance degradation due to deterioration of the light-emitting layer occurs, there are instances where, for example, display unevenness occurs in the display, such as when burn-in phenomena such as residual images or color fade-out occur, or color drift in images displayed on the display occurs, or luminance in a portion of the display deteriorates.

In order to solve such problems, a technique of reducing display unevenness by correcting a video signal has been disclosed (for example, see Patent Literature (PTL) 1).

CITATION LIST

Patent Literature

PTL 1: Japanese Unexamined Patent Application Publication No. 2016-109939

SUMMARY

Technical Problem

In light-emitting elements such as electroluminescent elements, it is known that loss of carrier balance between hole injection characteristics and electron injection characteristics occurs in an initial period in which luminance deteriorates (hereafter referred to initial stage of deterioration), which is a period of, for example, up to 5,000 hours, and more specifically, 1,000 hours to 2,000 hours, from the start of use. It should be noted that carrier balance refers to the ratio between hole current and electron current in the organic EL element.

For this reason, in the period of the initial stage of deterioration of the light-emitting element, there are cases where even when a video signal is corrected using the above-described conventional technique, sufficient correction accuracy cannot be obtained due loss of carrier balance, etc., and, as a result, correction error occurs and display unevenness occurs on the display.

The present disclosure is conceived in view of the above-described circumstances and has as an object to provide a display device and a display device driving method which are capable of reducing display unevenness even during the period of initial stage of deterioration.

Solution to Problem

A display device according to an aspect of the present disclosure is a display device which includes a display screen in which pixels are arranged in a matrix, each of the pixels including a light-emitting element, the display device including: a correction circuit which corrects an input gradation value indicated by a luminance signal included in a video signal, wherein the correction circuit includes: a luminance converter which converts the input gradation value into a target luminance value corresponding to the input gradation value; a correction calculator which calculates an output gradation value from the target luminance value using an efficiency residual ratio which is an index representing a degree of deterioration of the light-emitting element, and calculates a corrected luminance value from the output gradation value, the output gradation value being obtained by correcting the input gradation value, the efficiency residual ratio indicating a residual ratio of light emission efficiency of the light-emitting element, the corrected luminance value being obtained by correcting the target luminance value; a current stress calculator which converts a current stress amount on the light-emitting element that is calculated from the corrected luminance value into a first stress amount indicating a current stress amount when a first reference current flows through the light-emitting element, and calculates an accumulated first stress amount obtained by accumulating the first stress amount resulting from the conversion; a carrier balance (CB) stress calculator which converts a CB stress amount, which is a stress amount due to carrier balance, on the light-emitting element into a second stress amount indicating a current stress amount when a second reference current flows through the light-emitting element or a second stress amount represented by an energizing time indicating a time for which current is supplied to the light-emitting element, and calculates an accumulated second stress amount obtained by accumulating the second stress amount resulting from the conversion; and an efficiency residual ratio calculator which updates the efficiency residual ratio, using the accumulated first stress amount and the accumulated second stress amount that are calculated.

Advantageous Effects

The present disclosure can provide a display device and a display device driving method which are capable of reducing display unevenness even during the period of initial stage of deterioration.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENT (Circumstances Leading to Obtainment of One Aspect of the Present Disclosure)

Figure 14:
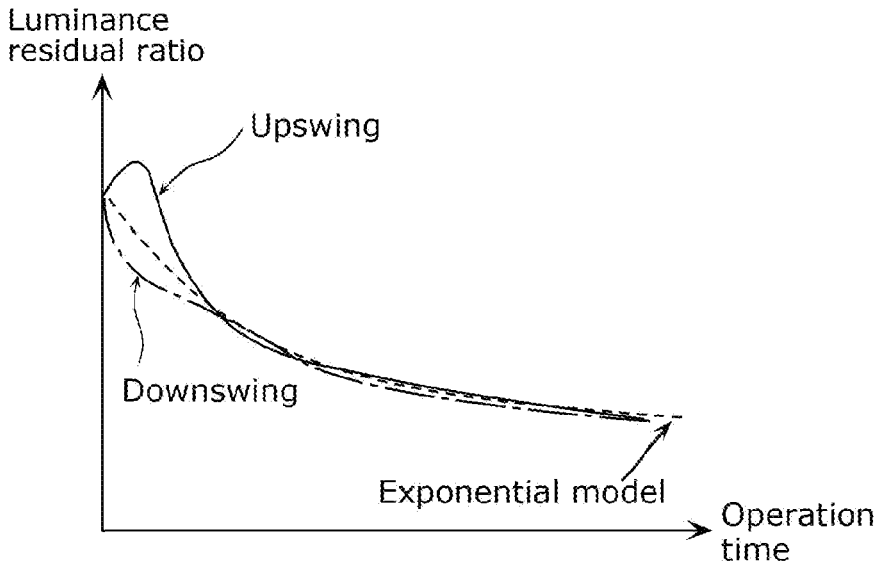
FIG. 14 is a graph illustrating an example of a relationship between the operation time of a light-emitting element and a luminance residual ratio of the light-emitting element, according to a model using exponential functions.

FIG. 14 is a graph illustrating an example of a relationship between the operation time of a light-emitting element and a luminance residual ratio of the light-emitting element, according to a model using exponential functions.

It is commonly known that the life span characteristics of a light-emitting element such as an organic EL element can be predicted by a model represented using exponential functions. It should be noted that the model is not limited to the case of being represented using exponential functions, for example. However, in the case of a light-emitting element such as an organic EL element, particularly in the period of the initial stage of deterioration, there are cases where the life span characteristics deviate from the model due to reasons such as loss of carrier balance. In the case where the life span characteristics deviate from the model using exponential functions, for example, in the period of the initial stage of deterioration, there are instances where luminance residual ratio swings up (upswing) higher than the model, and instances where the luminance residual ratio swings down (downswing) lower than the model. In this manner, particularly in the period of the initial stage of deterioration, the life span characteristics do not follow the prediction according to the model, and thus cannot be predicted using the model.

Therefore, in the period of the initial stage of deterioration which is a period of for example up to 5,000 hours, and more specifically, 1,000 hours to 2,000 hours, from the start of use of the light-emitting element, there are cases where even when the video signal is corrected using the above-described conventional technique, sufficient correction accuracy cannot be obtained, and, as a result, correction error occurs and display unevenness occurs on the display.

A display device according to an aspect of the present disclosure is a display device which includes a display screen in which pixels are arranged in a matrix, each of the pixels including a light-emitting element. The display device includes: a correction circuit which corrects an input gradation value indicated by a luminance signal included in a video signal. The correction circuit includes: a luminance converter which converts the input gradation value into a target luminance value corresponding to the input gradation value; a correction calculator which calculates an output gradation value from the target luminance value using an efficiency residual ratio which is an index representing a degree of deterioration of the light-emitting element, and calculates a corrected luminance value from the output gradation value, the output gradation value being obtained by correcting the input gradation value, the efficiency residual ratio indicating a residual ratio of light emission efficiency of the light-emitting element, the corrected luminance value being obtained by correcting the target luminance value; a current stress calculator which converts a current stress amount on the light-emitting element that is calculated from the corrected luminance value into a first stress amount indicating a current stress amount when a first reference current flows through the light-emitting element, and calculates an accumulated first stress amount obtained by accumulating the first stress amount resulting from the conversion; a carrier balance (CB) stress calculator which converts a CB stress amount, which is a stress amount due to carrier balance, on the light-emitting element into a second stress amount indicating a current stress amount when a second reference current flows through the light-emitting element or a second stress amount represented by an energizing time indicating a time for which current is supplied to the light-emitting element, and calculates an accumulated second stress amount obtained by accumulating the second stress amount resulting from the conversion; and an efficiency residual ratio calculator which updates the efficiency residual ratio, using the accumulated first stress amount and the accumulated second stress amount that are calculated.

According to this configuration, display unevenness can be reduced even in the period of the initial stage of deterioration.

More specifically, by independently calculating the stress amount due to current and the stress amount due to reasons such as loss of carrier balance, it is possible to accurately calculate the accumulated stress due to current and the accumulated stress due to reasons such as loss of carrier balance. For this reason, even in the period of the initial stage of deterioration, an efficiency residual ratio that takes into consideration the stress amount due to reasons such as loss of carrier balance can be accurately calculated and updated. In addition, since the degree of deterioration of the light-emitting element can be accurately predicted even in the period of the initial stage of deterioration by using the updated efficiency residual ratio, an input gradation value that has been corrected taking into consideration the degree of deterioration of the light-emitting element, that is, the output gradation value can be accurately calculated. Accordingly, respective light-emitting elements can be corrected to a similar light emission luminance regardless of the degree of deterioration of each light-emitting element, and thus display unevenness can be reduced.

Furthermore, for example the efficiency residual ratio may be expressed by a ratio of a light emission luminance of the light-emitting element after deterioration to a light emission luminance of the light-emitting element at an initial stage of operation. The efficiency residual ratio calculator may: calculate, using a relationship between a luminance of the light-emitting element and an accumulated time for which the first reference current flows through the light-emitting element, a first efficiency residual ratio that is new and attributable to current stress, from the accumulated time which is calculated as the accumulated first stress amount; calculate, using a relationship between the luminance of the light-emitting element and an accumulated time for which the second reference current flows through the light-emitting element or a relationship between the luminance of the light-emitting element and an accumulated time of the energizing time, a second efficiency residual ratio that is new and attributable to the carrier balance; and update the efficiency residual ratio by calculating the efficiency residual ratio from the first efficiency residual ratio and the second efficiency residual ratio.

According to this configuration, a new first efficiency residual ratio attributed to current stress and a new second efficiency residual ratio attributed to stress due to reasons such as loss of carrier balance are independently calculated. With this, it is possible to accurately calculate an efficiency residual ratio that takes into consideration stress due to reasons such as loss of carrier balance in addition to stress due to current.

Furthermore, the current stress amount calculated from the corrected luminance value may be a stress amount for a first current that flows through the light-emitting element when the light-emitting element is caused to emit light according to the corrected luminance value. The stress amount for the first current may be equivalent to a time for which the first current flows through the light-emitting element, and a stress amount for the first reference current may be equivalent to a time for which the first reference current flows through the light-emitting element. The current stress calculator may convert the current stress amount calculated from the corrected luminance value into the first stress amount by converting the time for which the first current flows through the light-emitting element into the time for which the first reference current flows through the light-emitting element.

According to this configuration, by evaluating the current stress amount using the time for which the first reference current flows through the light-emitting element, the stress amount due to current can be appropriately calculated, and the accumulated stress amount due to current can be accurately calculated.

Furthermore, when converting the CB stress amount into the second stress amount indicating the current stress amount when the second reference current flows through the light-emitting element: the CB stress amount may be calculated using the corrected luminance value or a time for which current is supplied to the light-emitting element in order to cause the light-emitting element to emit light; the CB stress amount may be equivalent to a time for which a second current flows through the light-emitting element when the light-emitting element is caused to emit light according to the corrected luminance value; a stress amount for the second reference current may be equivalent to a time for which the second reference current flows through the light-emitting element; and the current stress calculator may convert the CB stress amount into the second stress amount by converting the time for which the second current flows through the light-emitting element into the time for which the second reference current flows through the light-emitting element.

According to this configuration, by evaluating the stress amount due to reasons such as loss of carrier balance using the time for which the second reference current flows, the stress amount due to reasons such as loss of carrier balance can be appropriately calculated, and the accumulated stress amount due to reasons such as loss of carrier balance can be accurately calculated.

Furthermore, a method of driving a display device according to an aspect of the present disclosure is a method of driving a display device which includes a display screen in which pixels are arranged in a matrix, each of the pixels including a light-emitting element. The method includes: correcting an input gradation value indicated by a luminance signal included in a video signal. The correcting includes: converting the input gradation value into a target luminance value corresponding to the input gradation value; calculating an output gradation value from the target luminance value using an efficiency residual ratio which is an index representing a degree of deterioration of the light-emitting element, and calculating a corrected luminance value from the output gradation value, the output gradation value being obtained by correcting the input gradation value, the efficiency residual ratio indicating a residual ratio of light emission efficiency of the light-emitting element, the corrected luminance value being obtained by correcting the target luminance value; converting a current stress amount on the light-emitting element that is calculated from the corrected luminance value into a first stress amount indicating a current stress amount when a first reference current flows through the light-emitting element, and calculating an accumulated first stress amount obtained by accumulating the first stress amount resulting from the conversion; converting a CB stress amount, which is a stress amount due to carrier balance, on the light-emitting element into a second stress amount indicating a current stress amount when a second reference current flows through the light-emitting element, and calculating an accumulated second stress amount obtained by accumulating the second stress amount resulting from the conversion; and updating the efficiency residual ratio, using the accumulated first stress amount and the accumulated second stress amount that were calculated.

It should be noted that these generic and specific aspects may be implemented as a device, a system, a method, or an integrated circuit, or may be implemented as any combination of a device, a system, a method, and an integrated circuit.

Hereinafter, exemplary embodiments of the present invention will be described with reference to the drawings. Each of the exemplary embodiments described below shows one preferred example of the present disclosure. Therefore, numerical values, shapes, materials, structural components, the arrangement and connection of the structural components, etc., shown in the following exemplary embodiments are mere examples, and are not intended to limit the scope of the present disclosure. Furthermore, among the structural components in the following exemplary embodiment, components not recited in any one of the independent claims which indicate the broadest concepts of the present disclosure are described as arbitrary structural components.

It should be noted that the respective figures are schematic diagrams and are not necessarily precise illustrations. Furthermore, in the respective figures, the same reference sign is given to substantially identical components, and overlapping description is omitted or simplified.

Embodiment

[Configuration of Display Device]

Display device 1 according to the present disclosure is a display device including a display screen in which pixels, each including a light-emitting element, are arranged in a matrix.

Hereinafter, the configuration of display device 1 according to the present embodiment will be described.

Figure 1:
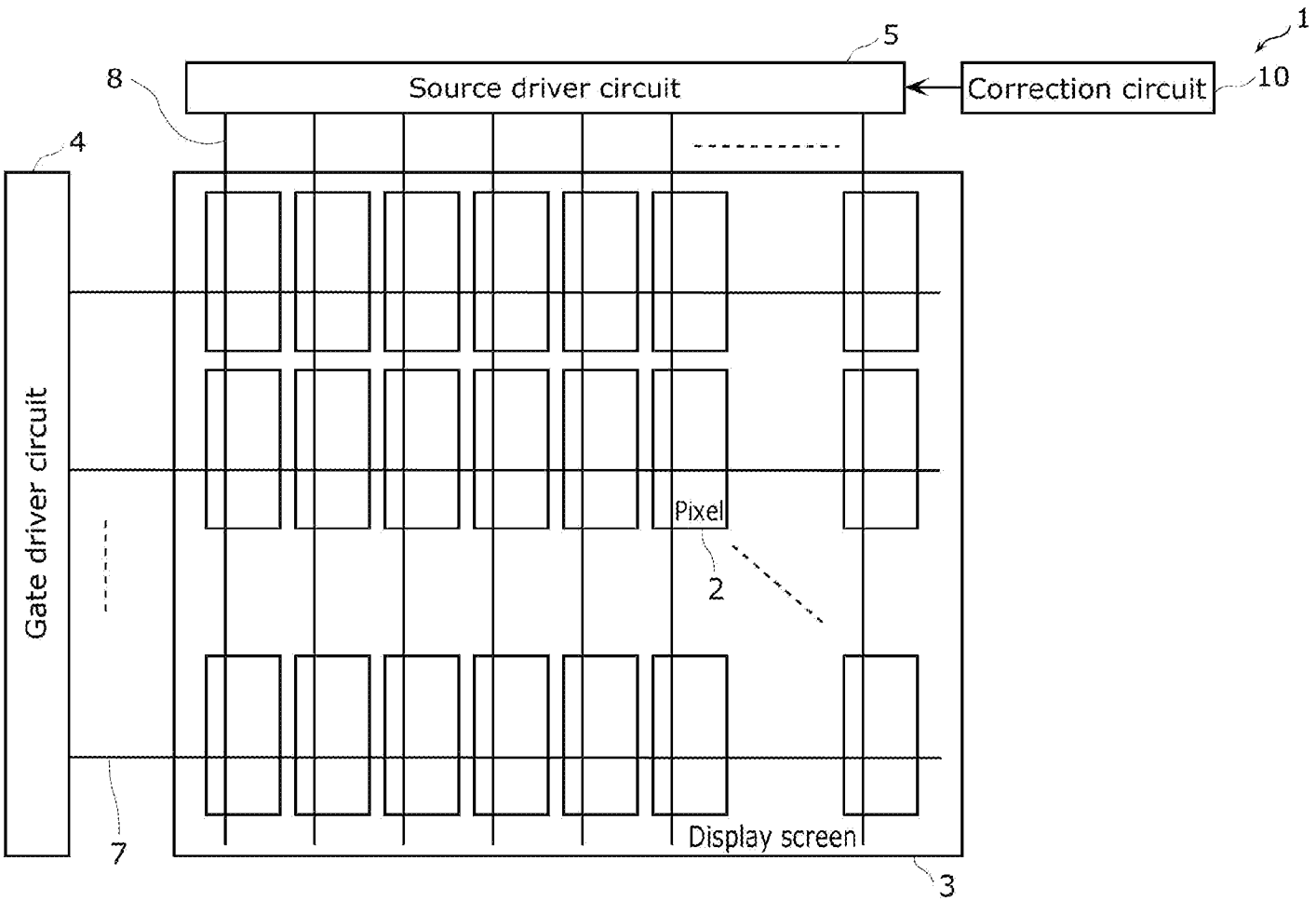
FIG. 1 is an outline diagram illustrating a configuration of a display device according to an embodiment.

FIG. 1 is an outline diagram illustrating the configuration of display device 1 according to the present embodiment.

As illustrated in FIG. 1, in the present embodiment, display device 1 includes display screen 3, gate driver circuit 4, source driver circuit 5, and correction circuit 10.

(Display Screen 3)

Display screen 3 displays video based on a video signal inputted to display device 1 from the outside. Here, the video signal includes at least a luminance signal, a vertical synchronization signal, and a horizontal synchronization signal. In the present embodiment, the luminance signal indicates, by a gradation value, the luminance of each subpixel of each of the pixels included in display screen 3. Hereinafter, the gradation value indicated by the luminance signal will be referred to as the input gradation value.

Furthermore, as illustrated in FIG. 1, in the present embodiment, display screen 3 includes pixels 2 arranged in a matrix, and rows of scanning lines 7 and columns of data lines 8 are provided.

(Pixel 2)

Figure 2:
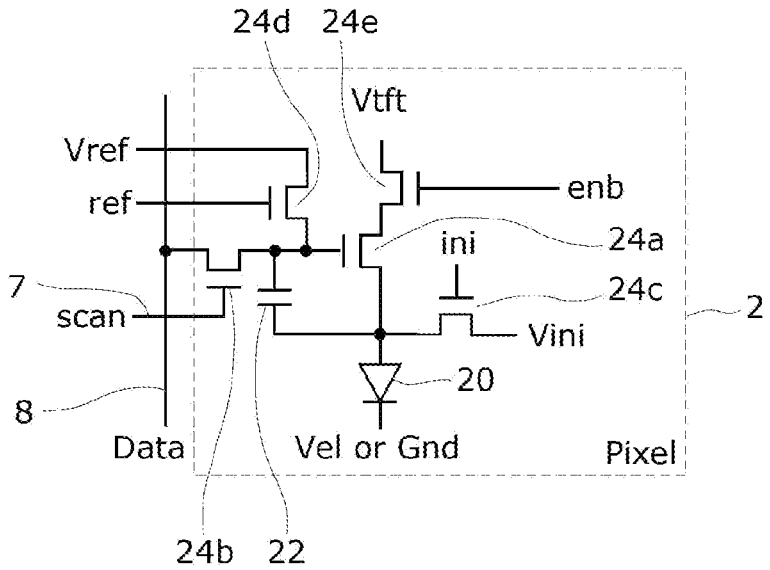
FIG. 2 is a circuit diagram illustrating a configuration of a pixel according to an embodiment.

FIG. 2 is a circuit diagram illustrating a configuration of pixel 2 according to the present embodiment.

Each of pixels 2 is electrically connected to scanning line 7 and data line 8. More specifically, as illustrated in FIG. 1, each of pixels 2 is disposed at a position at which one scanning line 7 and one data line 8 cross. Furthermore, pixels 2 are arranged in, for example, N rows and M columns. N and M are positive integers, and are different depending on the size and resolution of display screen 3.

As illustrated in FIG. 2, in the present embodiment, reference power supply line Vref, EL anode power supply line Vtft, EL cathode power supply line Vel, initialization power supply line Vini, reference voltage control line ref, initialization control line ini, and enable line enb are provided in pixel 2. Here, EL anode power supply line Vtft supplies the anode voltage applied to light-emitting element 20. EL cathode power supply line Vel supplies the cathode voltage applied to light-emitting element 20. It should be noted that EL cathode power supply line Vel may be grounded. Initialization power supply line Vini supplies an initialization voltage when capacitive element 22 is initialized.

Furthermore, as illustrated in FIG. 2, in the present embodiment, pixel 2 includes light-emitting element 20, capacitive element 22, drive transistor 24*a*, and switch transistors 24*b* to 24*e*.

Light-emitting element 20 includes a cathode connected to EL cathode power supply line Vel, and an anode connected to the source of drive transistor 24*a*. When current corresponding to a signal voltage of a video signal (luminance signal) supplied from drive transistor 24*a* flows through light-emitting element 20, light-emitting element 20 emits light at a luminance that is in accordance with the signal voltage. In the present embodiment, the current corresponding to the signal voltage of a video signal is a current corresponding to the signal voltage of the video signal that has been corrected by correction circuit 10. Although details are to be described later, the current corresponding to the signal voltage of the video signal corrected by correction circuit 10 is a current corresponding to a gradation value (i.e., output gradation value) of the luminance indicated by the luminance signal included in the video signal. Here, the gradation value has been corrected by correction circuit 10.

Light-emitting element 20 is an organic EL element such as an organic light-emitting diode (OLED), for example. It should be noted that light-emitting element 20 is not limited to an organic EL element, and may be a luminescent element such as an inorganic EL element a quantum-dot light-emitting diode (QLED), and need not be a luminescent element when it is an element controlled by being current driven.

Drive transistor 24*a* includes a gate connected to one electrode of capacitive element 22, etc., a drain connected to the source of switch transistor 24*e*, and a source connected to the anode of light-emitting element 20. In FIG. 2, the source of drive transistor 24*a* is further connected to the other electrode of capacitive element 22, etc. Drive transistor 24*a* converts the signal voltage applied across the gate and source into a current (referred to as drain-source current) corresponding to the signal voltage. Then, by being placed in the ON state, drive transistor 24*a* applies (supplies) the drain-source current to light-emitting element 20 to cause light-emitting element 20 to emit light. Drive transistor 24*a* is configured of, for example, an n-type thin film transistor (n-type TFT).

Switch transistor 24*e* includes a gate connected to enable line enb, a drain connected to EL anode power supply line Vtft, and a source connected to the drain of drive transistor 24*a*. Switch transistor 24*e* is placed in the ON state or the OFF state according to a quenching signal supplied from enable line enb. By being placed in the ON state, switch transistor 24*e* connects drive transistor 24*a* to EL anode power supply line Vtft to cause the drain-source current of drive transistor 24*a* to be supplied to light-emitting element 20. Switch transistor 24*e* is configured of, for example, an n-type thin film transistor (n-type TFT).

Switch transistor 24*b* includes a gate connected to scanning line 7, a drain connected to data line 8, and a source connected to the one electrode of capacitive element 22. Switch transistor 24*b* is placed in the ON state or the OFF state according to a control signal supplied from scanning line 7. By being placed in the ON state, switch transistor 24*b* applies the signal voltage of the video signal supplied from data line 8 to the electrode of capacitive electrode 22 to cause a charge corresponding to the signal voltage to be accumulated in capacitive element 22. Switch transistor 24*b* is configured of, for example, an n-type thin film transistor (n-type TFT).

Switch transistor 24*d* includes a gate connected to reference voltage control line ref, a drain connected to reference power supply line Vref, and a source connected to the one electrode of capacitive element 22, etc. Switch transistor 24*d* is placed in the ON state or the OFF state according to a control signal supplied from reference voltage control line ref. By being placed in the ON state, switch transistor 24*d* sets the electrode of capacitive element 22 to the voltage supplied by reference power supply line Vref. Switch transistor 24*d* is configured of, for example, an n-type thin film transistor (n-type TFT).

Switch transistor 24*c* includes a gate connected to initialization control line ini, one of a source and a drain connected to the source of drive transistor 24*a*, and the other of the source and the drain connected to initialization power supply line Vini. Switch transistor 24*c* is placed in the ON state or the OFF state according to a control signal supplied from initialization control line ini. By being placed in the ON state while drive transistor 24*a* is in the ON state and switch transistor 24*e* is in the OFF state, and the connection with EL anode power supply line Vtft is cut off, switch transistor 24*c* sets the anode of light-emitting element 20 to the initialization voltage (reference voltage) supplied by initialization power supply line Vini. Switch transistor 24*c* is configured of, for example, an n-type thin film transistor (n-type TFT).

Capacitive element 22 is a capacitor that includes the one electrode connected to the gate of drive transistor 24*a*, the source of switch transistor 24*b*, and the source of switch transistor 24*d*, and the other electrode connected to the source of drive transistor 24*a*. Capacitive element 22 accumulates a charge corresponding to the signal voltage supplied from data line 8. Capacitive element 22, for example, stably holds the gate-source voltage of drive transistor 24*a* after switch transistor 24*b* and switch transistor 24*d* are placed in the OFF state. In this manner, when switch transistor 24*b* and switch transistor 24*d* are in the OFF state, capacitive element 22 applies the gate-source voltage of drive transistor 24*a* according to the signal potential of the accumulated charge.

With this configuration pixel 2 can stably pass current to light-emitting element 20.

It should be noted that the configuration of pixel 2 is not limited to the configuration in illustrated in FIG. 2, and may be another configuration. As a minimum configuration that is capable of at least achieving the functions of pixel 2, it is sufficient that light-emitting element 20, capacitive element 22, drive transistor 24*a*, and switch transistor 24*b* be included.

Scanning line 7 is provided for each row of pixels 2. One end of scanning line 7 is connected to pixel 2, and the other end of scanning line 7 is connected to gate driver circuit 4. In the example illustrated in FIG. 2, scanning line 7 is connected to the gate of switch transistor 24*b* disposed in pixel 2.

Data line 8 is provided for each column of pixels 2. One end of data line 8 is connected to pixel 2, and the other end of data line 8 is connected to source driver circuit 5. In the example illustrated in FIG. 2, data line 8 is connected to the drain of switch transistor 24*b*.

(Gate Driver Circuit 4)

Scanning lines 7 are connected to gate driver circuit 4, and gate driver circuit 4 controls the turning ON and OFF of respective transistors included in each pixel 2 by outputting a control signal to scanning lines 7. In the example illustrated in FIG. 2, gate driver circuit 4 supplies a scanning signal to the gate of switch transistor 24*b* disposed in pixel 2, via scanning line 7.

(Source Driver Circuit 5)

Data lines 8 are connected to source driver circuit 5, and source driver circuit 5 supplies the video signal corrected by correction circuit 10 to respective pixels 2 by outputting the video signal to data lines 8. Source driver circuit 5 writes the output gradation value representing the luminance indicated by the video signal in each of pixels 2, in the form of a current value or a voltage value, via data lines 8. In the example illustrated in FIG. 2, source driver circuit 5 supplies, via data line 8, a voltage corresponding to the video signal input to the drain of switch transistor 24*b* disposed in pixel 2.

(Correction Circuit 10)

Correction circuit 10 corrects a video signal inputted from the outside, and outputs the corrected video signal to source driver circuit 5. More specifically, correction circuit 10 corrects the input gradation value indicated by the luminance signal included in the video signal to output an output gradation value. Accordingly, the output gradation value is outputted to source driver circuit 5 as the gradation indicated by the luminance signal included in the video signal.

Stated differently, correction circuit 10 is a circuit for correcting the gradation value (i.e., input gradation value) of the luminance indicated by the luminance signal included in the video signal so that light-emitting element 20 emits light at the targeted luminance, that is, the target luminance value. It should be noted that the target luminance value corresponds to the light-emission luminance value corresponding to the input gradation value, in a light-emitting element 20 that is in an initial stage of operation with no deterioration. For this reason, when light-emitting element 20 deteriorates, the target luminance value cannot be achieved even if light-emitting element 20 is caused to emit light by supplying the current value corresponding to the input gradation value indicated by the luminance signal included in the video signal. In view of this, correction circuit 10 corrects the input gradation value indicated by the luminance signal included in the video signal to be able to achieve the target luminance value. Accordingly, light-emitting element 20 which has been supplied with current corresponding to the corrected input gradation value (i.e., output gradation value) can achieve the targeted luminance, that is, the target luminance value.

The configuration of correction circuit 10 will be described below.

[Configuration of Correction Circuit 10]

Figure 3:
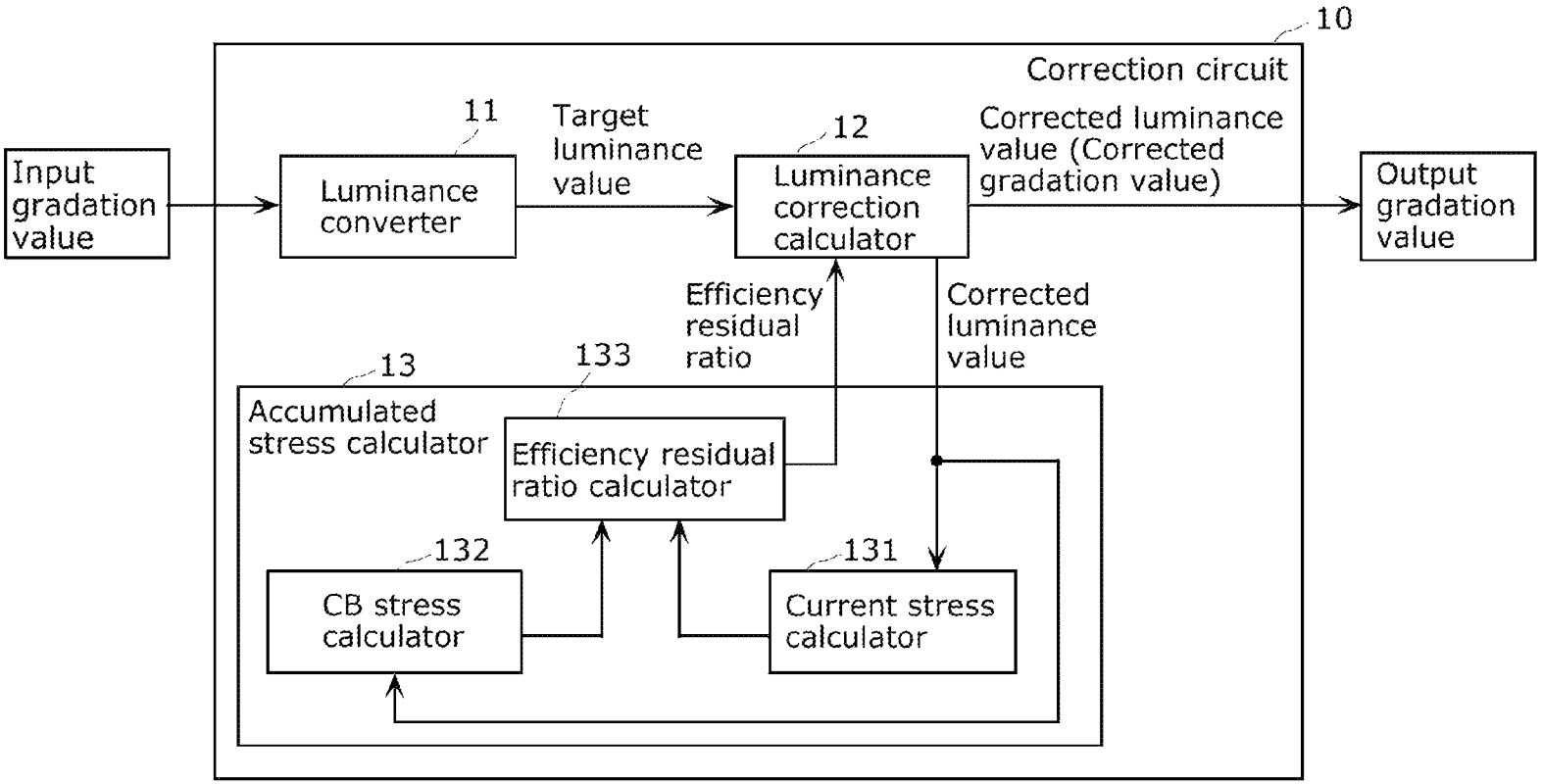
FIG. 3 is a block diagram illustrating an example of a configuration of a correction circuit according to an embodiment.

FIG. 3 is a block diagram illustrating an example of a configuration of correction circuit 10 according to the present embodiment.

Correction circuit 10 includes luminance converter 11, luminance correction calculator 12, and accumulated stress calculator 13. Correction circuit 10 can be implemented by a processor executing a predetermined program using a memory. The respective structural components will be described below.

(Luminance Converter 11)

Luminance converter 11 converts the input gradation value into the corresponding target luminance value. In the present embodiment, luminance converter 11 converts the input gradation value indicated by the luminance signal included in the video signal inputted from the outside of display device 1 into the corresponding target luminance value.

This will be described using FIG. 4.

Figure 4:
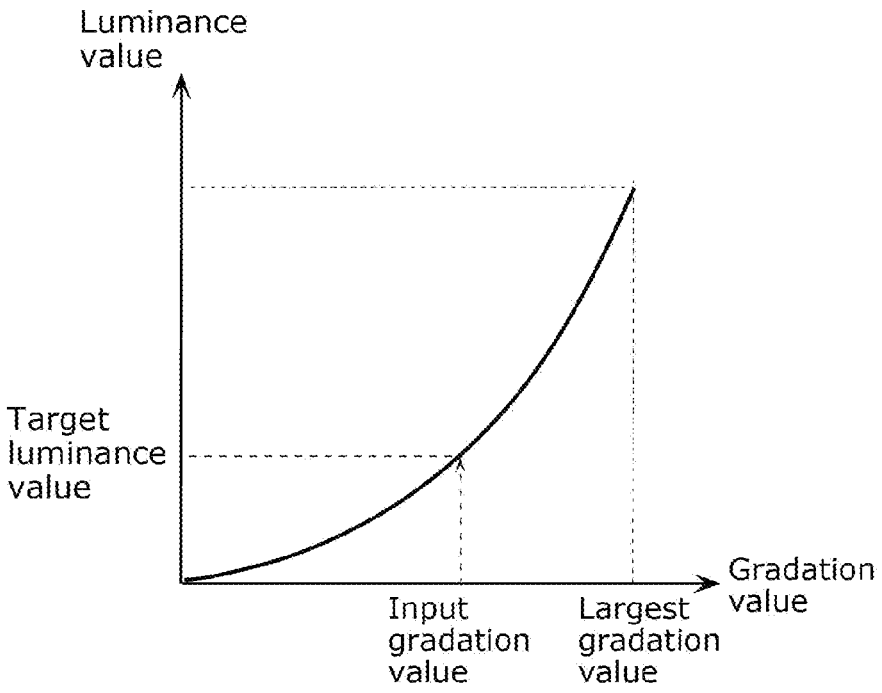
FIG. 4 is a graph for describing a method of converting an input gradation value into a target luminance value according to an embodiment.

FIG. 4 is a graph for describing a method of converting the input gradation value into a target luminance value according to the present embodiment. FIG. 4 illustrates gradation-luminance characteristics representing the relationship between the gradation value and the luminance value of light-emitting element 20 that is in an initial stage of operation.

Using the relationship shown by the gradation-luminance characteristics in FIG. 4, luminance converter 11 can convert the input gradation value indicated by the luminance signal included in the video signal inputted from the outside of display device 1 into the corresponding target luminance value.

(Luminance Correction Calculator 12)

Using the efficiency residual ratio which is an index representing the degree of deterioration of light-emitting element 20 and indicates the residual ratio of the light-emitting efficiency of light-emitting element 20, luminance correction calculator 12 calculates, from the target luminance value, the output gradation value obtained by correcting the input gradation value, and calculates, from the calculated output gradation value, the corrected luminance value obtained by correcting the target luminance value. Here, efficiency residual ratio is expressed by the ratio of the post-deterioration light-emitting luminance of light-emitting element 20 to the initial light-emitting luminance of light-emitting element 20.

In the present embodiment, luminance correction calculator 12 calculates the output gradation value from the target luminance value outputted by luminance converter 11, using the efficiency residual ratio which is obtained from accumulated stress calculator 13 and takes into consideration the stress due to reasons such as loss of carrier balance. Here, the output gradation value is the corrected gradation value obtained by correcting the input gradation value indicated by the luminance signal included in the video signal inputted from the outside of display device 1. Luminance correction calculator 12 outputs the calculated output gradation value. Accordingly, luminance correction calculator 12 can output the calculated output gradation value to source driver circuit 5, as the gradation indicated by the luminance signal included in the video signal.

Furthermore, luminance correction calculator 12 calculates, from the calculated output gradation value, a corrected luminance value obtained by correcting the target luminance value. Luminance correction calculator 12 outputs the calculated corrected luminance value to accumulated stress calculator 13.

The method for calculating the output gradation value and the corrected luminance value will be described below using FIG. 5A and FIG. 5B.

Figure 5A:
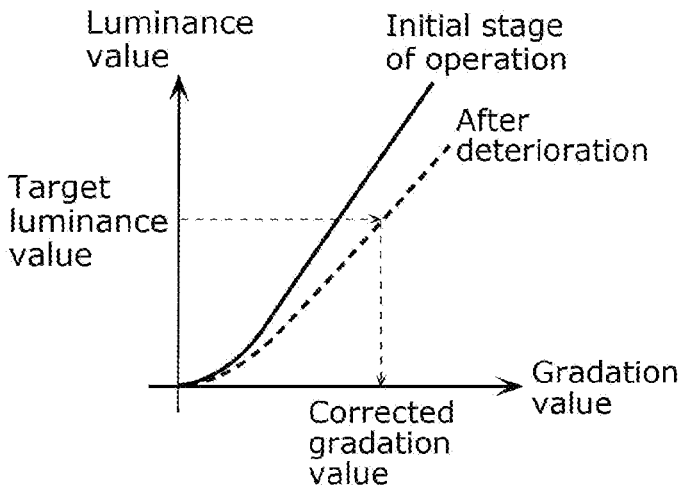
FIG. 5A is a graph for describing a method of calculating a corrected gradation value from a target luminance value according to an embodiment.

FIG. 5A is a graph for describing a method of calculating a corrected gradation value from a target luminance value according to the present embodiment. FIG. 5B is a graph for describing a method of calculating a corrected luminance value from a corrected gradation value according to the present embodiment. FIG. 5A and FIG. 5B illustrate gradation-luminance characteristics representing the relationship between the gradation value and the luminance value of light-emitting element 20 in the initial stage of operation and after deterioration. The gradation-luminance characteristics after deterioration can be obtained by multiplying the gradation-luminance characteristics at the initial stage of operation by efficiency residual ratio $\eta_{-x}$.

Using the relationship shown by the gradation-luminance characteristics after deterioration in FIG. 5A, luminance correction calculator 12 can calculate the gradation value corresponding to the target luminance value outputted by luminance converter 11, as the corrected gradation value obtained by correcting the input gradation value indicated by the luminance signal included in the video signal. Then, luminance correction calculator 12 outputs the calculated corrected gradation value as an output gradation value. Accordingly, the input gradation value indicated by the luminance signal included in the video signal inputted from the outside of display device 1 is corrected to become the output gradation value, and the output gradation value is inputted to source driver circuit 5.

Figure 5B:
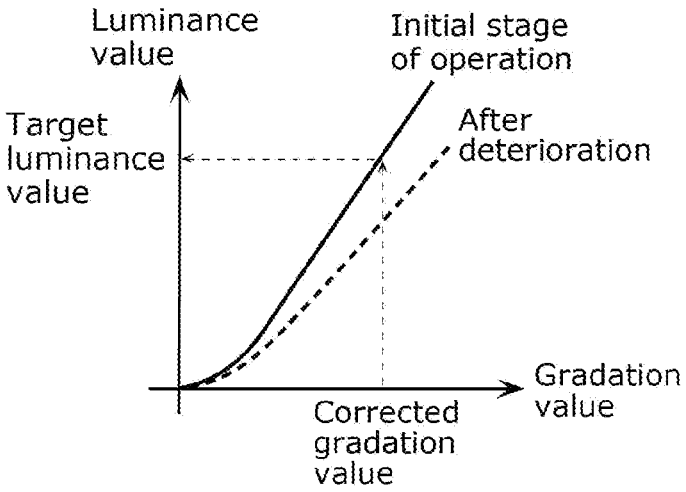
FIG. 5B is a graph for describing a method of calculating a corrected luminance value from a corrected gradation value according to an embodiment.

Furthermore, using the relationship shown by the gradation-luminance characteristics at the initial stage of operation in FIG. 5B, luminance correction calculator 12 can calculate the luminance value corresponding to the calculated corrected gradation value, as the corrected luminance value obtained by correcting the target luminance value outputted by luminance converter 11. Then, luminance correction calculator 12 outputs the calculated corrected luminance value to accumulated stress calculator 13.

(Accumulated Stress Calculator 13)

In the present embodiment, the deterioration behavior in the initial stage of operation (initial stage deterioration behavior) of light-emitting element 20 and the long-term deterioration behavior of light-emitting element 20 are calculated separately as independent phenomena. Here, the initial stage deterioration behavior refers to deterioration due to reasons such as loss of carrier balance, and long-term deterioration behavior refers to deterioration due to various currents. Specifically, accumulated stress calculator 13 calculates deterioration due to various currents and deterioration due to reasons such as loss of carrier balance separately as accumulated stress amounts due to current.

More specifically, accumulated stress calculator 13 independently calculates the accumulated stress amounts due to current and reasons such as loss of carrier balance by independently calculating the stress amount due to current and the stress amount due to reasons such as loss of carrier balance. In addition, accumulated stress calculator 13 calculates an efficiency residual radio that takes into consideration the stress due to reasons such as loss of carrier balance, by independently calculating a first efficiency residual ratio attributable to current stress and a second efficiency residual value attributable to carrier balance. Accordingly, even in the period of the initial stage of deterioration, accumulated stress calculator 13 can accurately calculate an efficiency residual ratio that takes into consideration stress due to reasons such as loss of carrier balance. It should be noted that, hereinafter, stress due to reasons such as loss of carrier balance is referred to as carrier balance (CB) stress.

In addition, accumulated stress calculator 13 updates the efficiency residual ratio used by luminance correction calculator 12 with the newly calculated efficiency residual ratio.

[Detailed Configuration of Accumulated Stress Calculator 13]

Next, the detailed configuration of accumulated stress calculator 13 according to the present embodiment will be described.

As illustrated in FIG. 3, in the present embodiment, accumulated stress calculator 13 includes current stress calculator 131, CB stress calculator 132, and efficiency residual ratio calculator 133. These components will be described in detail below.

(Current Stress Calculator 131)

Current stress calculator 131 converts the current stress amount on light-emitting element 20 that is calculated from the corrected luminance value into the first stress amount indicating the current stress amount when a first reference current flows through light-emitting element 20.

Here, the current stress amount that is calculated from the corrected luminance value is the amount of stress from a first current that flows through light-emitting element 20 when light-emitting element 20 is caused to emit light according to the corrected luminance value, and is equivalent to the time for which the first current flows through light-emitting element 20. In the same manner, the current stress amount for the first reference current is equivalent to the time for which the first reference current flows through light-emitting element 20.

For this reason, more specifically, current stress calculator 131 can convert the stress amount calculated from the corrected luminance value into the first stress amount by converting the time for which the first current flows through light-emitting element 20 into the time for which the first reference current flows through light-emitting element 20. Then, current stress calculator 131 calculates an accumulated first stress amount obtained by accumulating the first stress amount resulting from the conversion.

In this manner, since long-term deterioration is the deterioration due to various currents, long-term deterioration can be calculated using accumulated stress due to various currents. In the present embodiment, current stress calculator 131 converts the current stress amount on light-emitting element 20 due to various currents into current stress amount due to the first reference current and accumulates this.

Figure 6:
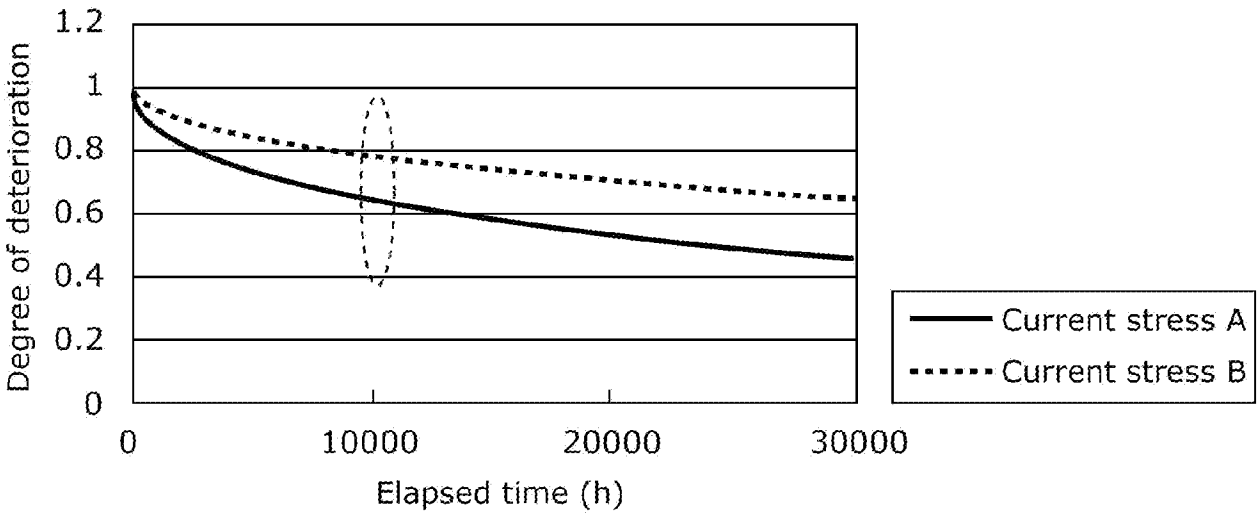
FIG. 6 is a graph illustrating a relationship between elapsed time and degree of deterioration of a light-emitting element.

FIG. 6 is a graph illustrating a relationship between elapsed time and degree of deterioration of a light-emitting element.

As described above, it is known that, in a light-emitting element (luminescent element) such as an organic EL element, the light-emitting layer included in the light-emitting element deteriorates according to the light-emission amount, the light-emission time (duration), and the temperature. FIG. 6 illustrates the degree of deterioration over elapsed time when a constant current is continuously applied to the light-emitting element, with the current applied to the light-emitting element as stress (called current stress). For current stress A and current stress B, the magnitude of the current applied to the light-emitting element is different, and current stress A is greater than current stress B, that is, the current applied as current stress A is greater than the current applied as current stress B.

As illustrated in FIG. 6, it can be seen that, when the light-emitting element is under current stress, deterioration advances with the passing of time. Furthermore, deterioration advances more when the light-emitting element is under current stress A than when the light-emitting element is under current stress B. Specifically, as indicated by the dotted line circle in FIG. 6, it can be seen that, even when the elapsed time is the same, the degree of deterioration is different according to the current stress, and the greater the current stress is, the more deterioration advances.

It should be noted that, since the magnitude of the current supplied to light-emitting element 20 is different (i.e., not constant) according to the input gradation value indicated by the luminance signal included in the video signal, it is difficult to simply express the relationship between elapsed time and the degree of deterioration of light-emitting element 20.

In view of this, in the present embodiment, the degree of long-term deterioration of luminance of light-emitting element 20 is evaluated as the degree of deterioration caused by the current stress amount on light-emitting element 20, using the degree of deterioration according to accumulated time (elapsed time) for the time when a constant current (i.e., reference current) is supplied to light-emitting element 20. Furthermore, in the present embodiment, the current stress amount is calculated by the current stress amount on light-emitting element 20 being evaluated using the time of various currents (first current) applied (supplied) to light-emitting element 20, and, in addition, being converted to the time for which the reference current flows through light-emitting element 20. Then, the current stress amount accumulated on light-emitting element 20 is calculated by calculating the accumulated time obtained by accumulating the time resulting from the conversion.

Figure 7A:
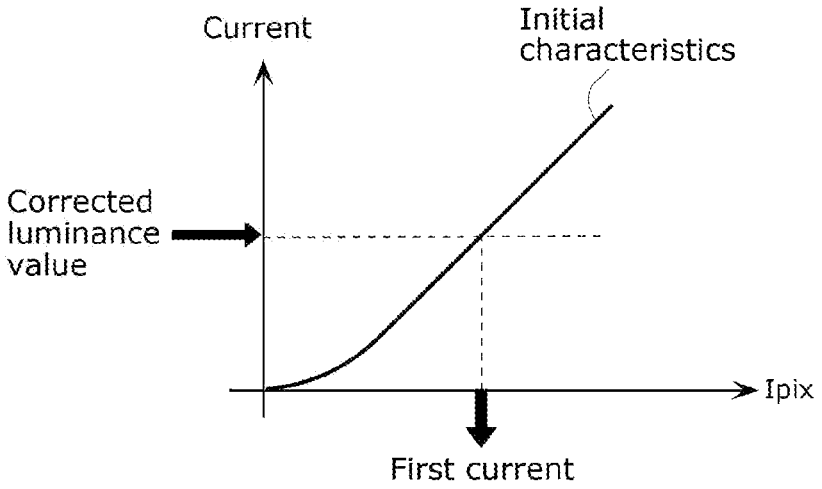
FIG. 7A is a graph for describing a method of calculating a first current value that flows when a light-emitting element is caused to emit light according to a corrected luminance value, according to an embodiment.

FIG. 7A is a graph for describing a method of calculating the first current value that flows when light-emitting element 20 is caused to emit light according to the corrected luminance value, according to the present embodiment. FIG. 7A illustrates a curve (initial characteristics) showing the relationship between luminance value and the current value flowing through light-emitting element 20 that is in an initial stage of operation.

Using the curve in FIG. 7A, current stress calculator 131 calculates, from the corrected luminance value outputted from luminance correction calculator 12, a first current that flows when light-emitting element 20 is caused to emit light according to the corrected luminance value.

Figure 7B:
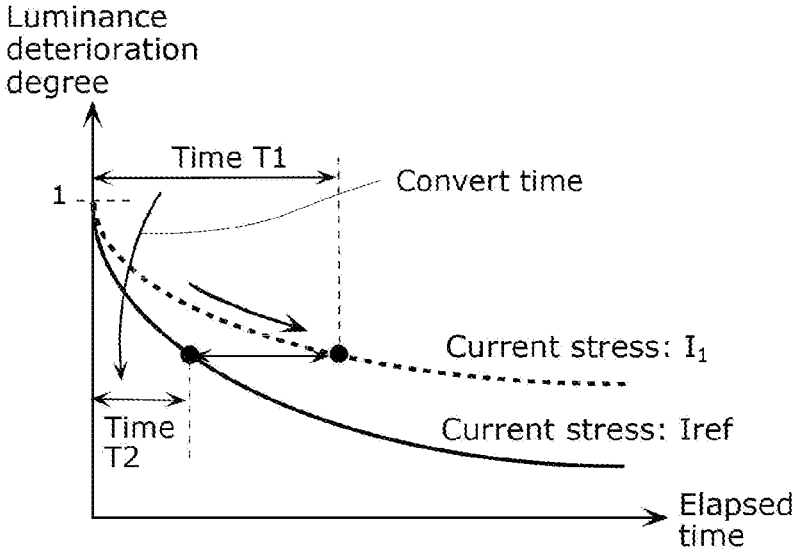
FIG. 7B is a graph for describing a method of converting a current stress amount when a first current flows through a light-emitting element into a current stress value when a first reference current flows through the light-emitting element, according to an embodiment.

FIG. 7B is a graph for describing a method of converting the current stress amount when the first current flows through light-emitting element 20 into the current stress value when the first reference current flows through light-emitting element 20, according to the present embodiment. The curves illustrated in FIG. 7B show the relationship between elapsed time and the degree of deterioration of the luminance of light-emitting element 20 when the first reference current and a first current flow through light-emitting element 20 as current stress. It should be noted that, in FIG. 7B, the degree of deterioration of the luminance of light-emitting element 20 at the initial stage of operation in which there is absolutely no current stress, is normalized to 1. Furthermore, each of the two curves illustrated in FIG. 7B is prepared in advance.

Current stress calculator 131 converts the time for which the first current flows into the time for which the first reference current flows through light-emitting element 20 so as to obtain a stress amount equivalent to the current stress amount when the first current is applied to light-emitting element 20. More specifically, using the curves shown in FIG. 7B, current stress calculator 131 converts time T1 for which the first current flows into time T2 for which the first reference current flows so as to obtain a luminance deterioration degree equivalent to the luminance deterioration degree when the first current is applied to light-emitting element 20 for time T1. Specifically, as illustrated in FIG. 7B, time T1 for which the first current flows through light-emitting element 20, that is, time T1 of current stress I1 can be converted into time T2 for which the first reference current flows through light-emitting element 20, that is, time T2 of current stress Iref. In this manner, current stress calculator 131 can convert the current stress amount that is calculated from the corrected luminance value into the first stress amount.

Then, current stress calculator 131 calculates accumulated time ΣT2 of time T2 as a first accumulated stress amount, by adding time T2 obtained as the first stress amount to time ΣT2 which is previously obtained and accumulated.

(CB Stress Calculator 132)

CB stress calculator 132 converts the stress amount due to carrier unbalance (i.e., the CB stress amount) on light-emitting element 20 into a second stress amount indicating the current stress amount when a second reference current flows through light-emitting element 20, and calculates the accumulated second stress amount obtained by accumulating the second stress amount resulting from the conversion. It should be noted that the second reference current is different from the above-described first reference current.

Here, when converting the CB stress amount on light-emitting element 20 into the second stress amount indicating the current stress amount when the second reference current flows through light-emitting element 20, the CB stress amount is calculated using the above-described corrected luminance value. More specifically, the CB stress amount can be evaluated using the time for which a second current flows through light-emitting element 20 when light-emitting element 20 is caused to emit light according to the corrected luminance value, and the stress amount for the second reference current can be evaluated using the time for which the second reference current flows through light-emitting element 20.

For this reason, more specifically, CB stress calculator 132 can convert the CB stress amount into the second stress amount by converting the time for which the second current flows through light-emitting element 20 into the time for which the second reference current flows through light-emitting element 20. Then, CB stress calculator 132 calculates the accumulated second stress amount obtained by accumulating the second stress amount resulting from the conversion.

In this manner, the deterioration at the initial stage of operation, that is, the deterioration due to reasons such as loss of carrier balance is considered to be the deterioration caused by current stress attributed to carrier balance, and the accumulated value of the CB stress on light-emitting element 20 is calculated as the accumulated value of current stress. Specifically, CB stress calculator 132 calculates the current stress amount on light-emitting element 20 caused by current as the CB stress, converts the calculated current stress into the current stress amount caused by the second reference current, and accumulates this.

Figure 8:
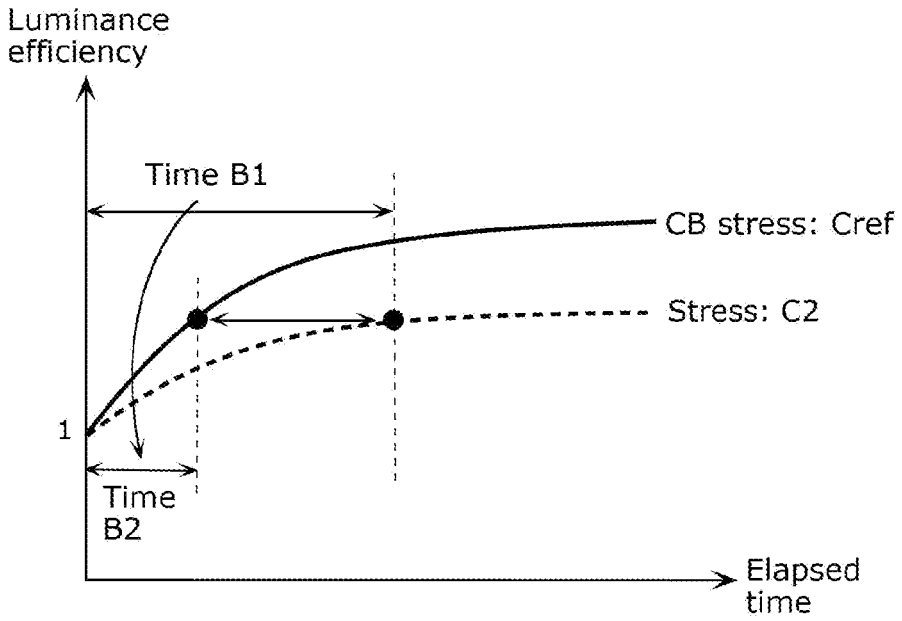
FIG. 8 is a diagram for describing a method of converting a change in luminance efficiency due to carrier balance into a stress amount due to a second reference current, according to an embodiment.

FIG. 8 is a diagram for describing a method of converting a change in luminance efficiency due to carrier balance into a stress amount due to a second reference current, according to the present embodiment. The curve indicated as "stress: C2" shows the relationship between the time for which the second current flows (elapsed time), as the CB stress on light-emitting element 20, and the luminance efficiency of light-emitting element 20. The curve indicated as "CB stress: Cref" shows the relationship between the time for which the second reference current flows (elapsed time), as the CB stress on light-emitting element 20, and the luminance efficiency of light-emitting element 20. It should be noted that, in FIG. 8, the luminance efficiency of light-emitting element 20 at the initial stage of operation in which there is absolutely no CB stress, is normalized to 1. Furthermore, each of the two curves illustrated in FIG. 8 is prepared in advance.

CB stress calculator 132 converts the time for which the second current flows through light-emitting element 20 into the time for which a second reference current flows through light-emitting element 20. Here, CB stress calculator 132 represents, with the time for which the second current flows through light-emitting element 20, the current stress amount when the second current is applied to light-emitting element 20 which is evaluated as the CB stress on light-emitting element 20. The time for which the second reference current flows through light-emitting element 20, which was obtained from the conversion, represents the current stress amount when the second reference current is applied to light-emitting element 20, and represents current stress amount that is equivalent to the current stress amount when the second current flows through light-emitting element 20. More specifically, using the curves illustrated in FIG. 8, CB stress calculator 132 converts time B1 for which the second current flows into time B2 for which the second reference current flows. With this conversion, the luminance efficiency when the second current is applied to light-emitting element 20 for time B1 and the luminance efficiency when the second reference current is applied to light-emitting element 20 for time B2 become equivalent luminance efficiencies. Specifically, as illustrated in FIG. 8, time B1 for which the second current flows through light-emitting element 20, that is, time B1 for "stress: C2" can be converted to time B2 for which the second reference current flows through light-emitting element 20, that is, time B2 for "CB stress: Cref". In this manner, CB stress calculator 132 can convert the current stress amount that is calculated from the corrected luminance value into the second stress amount.

Then, CB stress calculator 132 calculates accumulated time ΣB2 of time B2 as the accumulated second stress amount by further adding time B2 obtained as the second stress amount to the previously obtained and accumulated time ΣB2.

(Efficiency Residual Ratio Calculator 133)

Efficiency residual ratio calculator 133 updates an efficiency residual ratio using the calculated accumulated first stress amount and accumulated second stress amount. More specifically, using the relationship between the luminance of light-emitting element 20 and the accumulated time for which the first reference current flows through light-emitting element 20, efficiency residual ratio calculator 133 calculates a new first efficiency residual ratio attributable to current stress, from the accumulated time calculated as the accumulated first stress amount. Furthermore, using the relationship between the luminance of light-emitting element 20 and the accumulated time for which a second reference current flows through light-emitting element 20, efficiency residual ratio calculator 133 calculates a new second efficiency residual ratio attributable to carrier balance, from the accumulated time calculated as the accumulated second stress amount. In addition, efficiency residual ratio calculator 133 updates the efficiency residual ratio by calculating a new efficiency residual ratio from the calculated first efficiency residual ratio and second efficiency residual ratio.

Figure 9A:
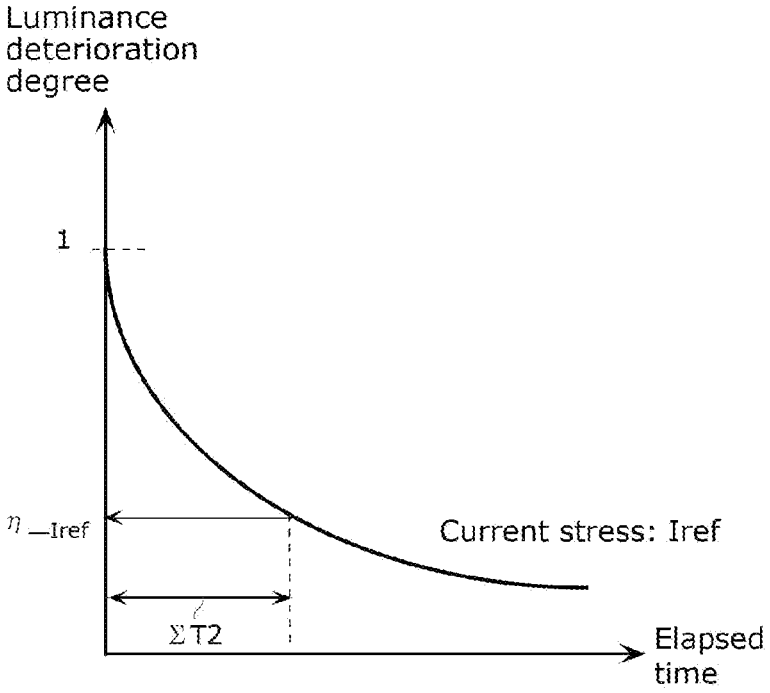
FIG. 9A is a graph for describing a method of calculating a first efficiency residual ratio attributable to current stress, from the degree of luminance deterioration when a first reference current flows through a light-emitting element for an accumulated time, according to an embodiment.

In the present embodiment, using the curve illustrated in FIG. 9A, efficiency residual ratio calculator 133 calculates first efficiency residual ratio $\eta_{_Iref}$ attributable to current stress from accumulated time ΣT2 calculated by current stress calculator 131.

FIG. 9A is a graph for describing a method of calculating first efficiency residual ratio $\eta_{_Iref}$ attributable to current stress, from the degree of deterioration of luminance when the first reference current flows through light-emitting element 20 for an accumulated time, according to the present embodiment. The curve illustrated in FIG. 9A shows the relationship between elapsed time (accumulated time) and the degree of deterioration of the luminance of light-emitting element 20 when the first reference current flows through light-emitting element 20 as current stress.

In the curve illustrated in FIG. 9A, the light emission luminance when accumulated time ΣT2 is 0 is not deteriorated, and thus corresponds to the light emission luminance of light-emitting element 20 at the initial stage of operation. For this reason, the light emission luminance of light-emitting element 20 for accumulated time ΣT2 can be expressed as the ratio of the light emission luminance of light-emitting element 20 after deterioration to the light emission luminance of light-emitting element 20 at the initial stage of operation. Specifically, using the curve illustrated in FIG. 9A, efficiency residual ratio calculator 133 can calculate first efficiency residual ratio $\eta_{_Iref}$ from accumulated time ΣT2. It should be noted that, in FIG. 9A, the undeteriorated light emission luminance of light-emitting element 20 at the initial stage of operation is normalized to 1.

Figure 9B:
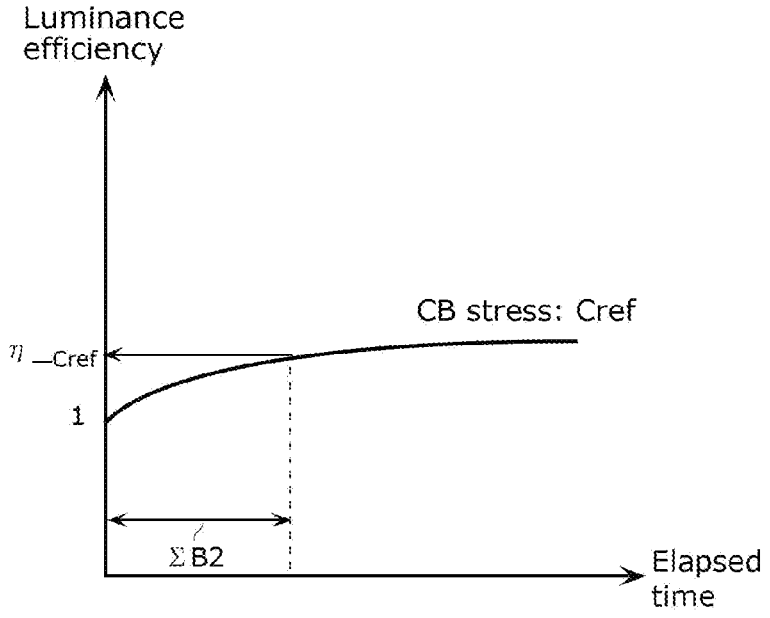
FIG. 9B is a graph for describing a method of calculating a second efficiency residual ratio attributable to carrier balance, from luminance efficiency when a second reference current flows through a light-emitting element for an accumulated time, according to an embodiment.

Furthermore, in the present embodiment, using the curve illustrated in FIG. 9B, efficiency residual ratio calculator 133 calculates second efficiency residual ratio $n_{_Cref}$ attributable to carrier balance, from accumulated time ΣB2 calculated by CB stress calculator 132.

FIG. 9B is a graph for describing a method of calculating second efficiency residual ratio $\eta_{_Cref}$ attributable to carrier balance, from the luminance efficiency when a second reference current flows through light-emitting element 20 for an accumulated time, according to the present embodiment. The curve illustrated in FIG. 9B shows the relationship between elapsed time (accumulated time) and the luminance efficiency of light-emitting element 20 for CB stress, that is, when the second reference current flows through light-emitting element 20, in the case where luminance residual ratio swings up (upswing).

In the curve illustrated in FIG. 9B, the luminance efficiency when accumulated time ΣB2 is 0 has not changed, and thus corresponds to the light emission luminance of light-emitting element 20 at the initial stage of operation. For this reason, the light emission luminance of light-emitting element 20 for accumulated time ΣB2 can be expressed as the ratio of the light emission luminance of light-emitting element 20 after deterioration (after a change in the luminance efficiency) to the light emission luminance of light-emitting element 20 at the initial stage of operation. Specifically, using the curve illustrated in FIG. 9B, efficiency residual ratio calculator 133 can calculate second efficiency residual ratio $\eta_{_Cref}$ from accumulated time ΣB2. It should be noted that, in FIG. 9B, the unchanged luminance efficiency of light-emitting element 20 at the initial stage of operation is normalized to 1.

In addition, in the present embodiment, efficiency residual ratio calculator 133 calculates efficiency residual ratio $\eta_{_x}$ which takes into consideration current stress and stress attributed to carrier balance, using separately (independently) calculated first efficiency residual ratio $\eta_{_Iref}$ attributable to current stress and second efficiency residual ratio $\eta_{_Cref}$ attributable to stress attributable to carrier balance.

More specifically, using (Equation 1) below, efficiency residual ratio calculator 133 calculates efficiency residual ratio $\eta_{_x}$ from separately (independently) calculated first efficiency residual ratio $\eta_{_Iref}$ and second efficiency residual ratio $\eta_{_Cref}$. In addition, efficiency residual ratio calculator 133 updates the immediately preceding efficiency residual ratio $\eta_{_x}$ with the calculated efficiency residual ratio $\eta_{_x}$.

[Math. 1]

$$\eta_{_x}=1-(1-\eta_{_Iref})+(\eta_{_Cref}-1) \quad \text{(Equation 1)}$$

As shown in (Equation 1), efficiency residual ratio $\eta_{_x}$ which takes into consideration current stress and stress attributable to carrier balance can be expressed in a form in which second efficiency residual ratio $\eta_{_Cref}$ attributable to carrier balance is added, in addition to first efficiency residual ratio $\eta_{_Iref}$ attributable to current stress. In other words, the deterioration of light-emitting element 20 due to current and the deterioration of light-emitting element 20 attributable to carrier balance are considered to be independent phenomena, and the deterioration of light-emitting element 20 can be expressed by adding together these phenomena. Then, in the period of the initial stage of deterioration such as, for example, 1,000 to 2000 hours from the start of use of light-emitting element 20, second efficiency residual ratio $\eta_{_Cref}$ attributable to carrier balance shows its effect in an upswing. In other words, even in the period of the initial stage of deterioration in which prediction according to a model such as that shown in FIG. 14 is not possible and luminance residual efficiency deviates from the model and swings up, an accurate efficiency residual ratio $\eta_{_x}$ can be calculated.

[Method of Driving Display Device 1]

Next, a method of driving display device 1 configured as described above will be described.

Figure 10:
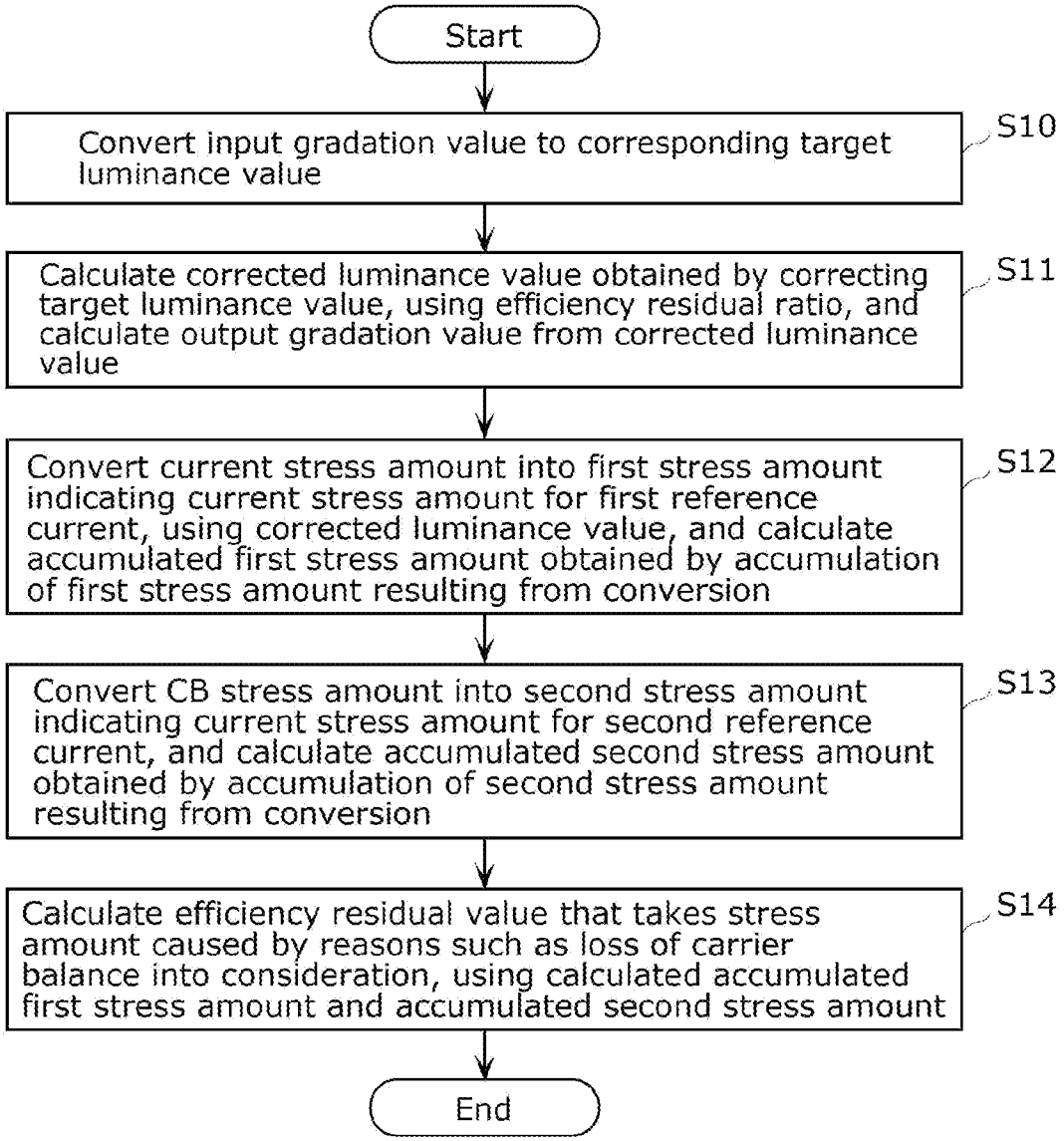
FIG. 10 is a flowchart illustrating an example of a display device driving method according to an embodiment.

FIG. 10 is a flowchart illustrating an example of a method of driving display device 1 according to the present embodiment. FIG. 10 illustrates a process performed by correction circuit 10 included in display device 1 as an example of a method of driving display device 1.

First, correction circuit 10 converts the input gradation value indicated by a luminance signal included in a video signal inputted from the outside of display device 1, into the corresponding target luminance value (S10).

Next, using the efficiency residual ratio, correction circuit 10 calculates an output gradation value obtained by correcting an input gradation value, from the target luminance value resulting from the conversion in step S10, and calculates a corrected luminance value obtained by correcting the target luminance value, from the output gradation value (S11). The efficiency residual ratio is calculated by accumulated stress calculator 13 in an immediately preceding process and so on.

Next, correction circuit 10 converts a current stress amount calculated from the corrected luminance value calculated in step S11 into a current stress amount for a first reference voltage, and calculates an accumulated first stress amount obtained by accumulating the current stress amount resulting from the conversion (S12). More specifically, correction circuit 10 converts the current stress amount on light-emitting element 20 calculated from the corrected luminance value calculated in step S11 into a first stress amount indicating the current stress amount when the first reference current flows through light-emitting element 20. Then, correction circuit 10 calculates the accumulated first stress amount obtained by accumulating the first stress amount resulting from the conversion.

Next, correction circuit 10 converts the CB stress amount into a second stress amount indicating the current stress amount for the second reference current, and calculates the accumulated second stress amount obtained by accumulating the second stress amount resulting from the conversion (S13). More specifically, correction circuit 10 converts the CB stress amount on light-emitting element 20 calculated from the corrected luminance value calculated in step S11 into a second stress amount indicating the current stress amount when the second reference current flows through light-emitting element 20. Then, correction circuit 10 calculates the accumulated second stress amount obtained by accumulating the second stress amount resulting from the conversion. Here, the order of step S12 and step S13 may be changed.

Next, correction circuit 10 calculates an efficiency residual ratio which takes into consideration the stress amount due to reasons such as loss of carrier balance, in addition to current stress amount, using the accumulated first stress amount and the accumulated second stress amount that were calculated in step S12 and step S13, respectively (S14).

[Advantageous Effects, Etc.]

As described above, with display device 1 according to the present embodiment, it is possible to reduce display unevenness even in the period of the initial stage of deterioration.

More specifically, as described above, the initial stage deterioration behavior and the long-term deterioration behavior of light-emitting element 20 are considered to be independent phenomena, and are calculated separately. Then, the initial stage deterioration, which is considered to be deterioration due to reasons such as loss of carrier balance, is calculated as the accumulated stress amount due to current, and the long-term deterioration, which is deterioration due to various currents, is calculated as an accumulated stress amount due to current.

Specifically, by independently calculating the CB stress amount and the stress amount due to current, display device 1 according to this embodiment can accurately calculate the accumulated stress amount due to current and the accumulated CB stress amount. For this reason, even in the period of the initial stage of deterioration, an efficiency residual ratio that takes into consideration stress due to reasons such as loss of carrier balance can be accurately calculated and updated. In addition, by using the updated efficiency residual ratio, the degree of deterioration of light-emitting element 20 can be accurately predicted even in the period of the initial stage of deterioration in which prediction by a model using exponential functions, for example, is not possible, and the luminance residual ratio deviates from the model and swings up (or swings down). With this, it is possible to calculate an input gradation value, that is, an output gradation value, that has been corrected to take into consideration the degree of deterioration of light-emitting element 20. Therefore, even in the period of the initial stage of deterioration in which prediction using the model is not possible, and the luminance residual ratio deviates from the model and swings up (or down), respective light-emitting elements 20 can be corrected to a similar light emission luminance regardless of the degree of deterioration of each light-emitting element 20, and thus display unevenness can be reduced.

Furthermore, display device 1 according to the present embodiment can accurately calculate and update an efficiency residual ratio that takes into consideration CB stress in addition to current stress, by independently calculating a first efficiency residual ratio attributable to current stress and a second efficiency residual ratio attributable to carrier balance.

Here, with initial stage deterioration and long-term deterioration being considered as independent phenomena, display device 1 according to the present embodiment independently calculates the accumulated stress amount due to current and the accumulated stress amount due to reasons such as loss of carrier balance.

Specifically, initial stage deterioration is considered to be the accumulation of the stress amount due to reasons such as loss of carrier balance, that is, the accumulation of the CB stress amount, and is evaluated using the accumulated value of the stress amount due to the second reference current. More specifically, display device 1 according to the present embodiment evaluates the CB stress amount using the time for which the second reference current flows through the light-emitting element to thereby appropriately calculate the CB stress amount as well as calculate the accumulated second stress amount obtained by accumulating the CB stress amount.

Furthermore, the long-term deterioration is considered to be deterioration due to stress from various currents, and is evaluated using the accumulated value of the stress amount due to the first reference current. More specifically, display device 1 according to the present embodiment evaluates the current stress amount using the time for which the first reference current flows through the light-emitting element to thereby appropriately calculate the stress amount due to current, and calculate the accumulated first stress amount obtained by accumulating the stress amount due to current.

Although display device 1 according to an exemplary embodiment and working examples has been described above, display device 1 is not limited to the above-described exemplary embodiment.

For example, a gain calculator may be provided to the above-described correction circuit 10, and when the efficiency residual ratio obtained from the accumulation stress calculator is small, the efficiency residual value may be amplified according to a gain calculated by the gain calculator.

Furthermore, above-described correction circuit 10 evaluates the accumulation of the stress amount attributable to carrier balance, that is, the accumulation of CB stress amount using the accumulated value of the stress amount due to the second reference current, but is not limited to such. The CB stress amount may be evaluated using the energizing time of light-emitting element 20, and the accumulation of the CB stress amount may be evaluated as the accumulated time of the energizing time.

Figure 11:
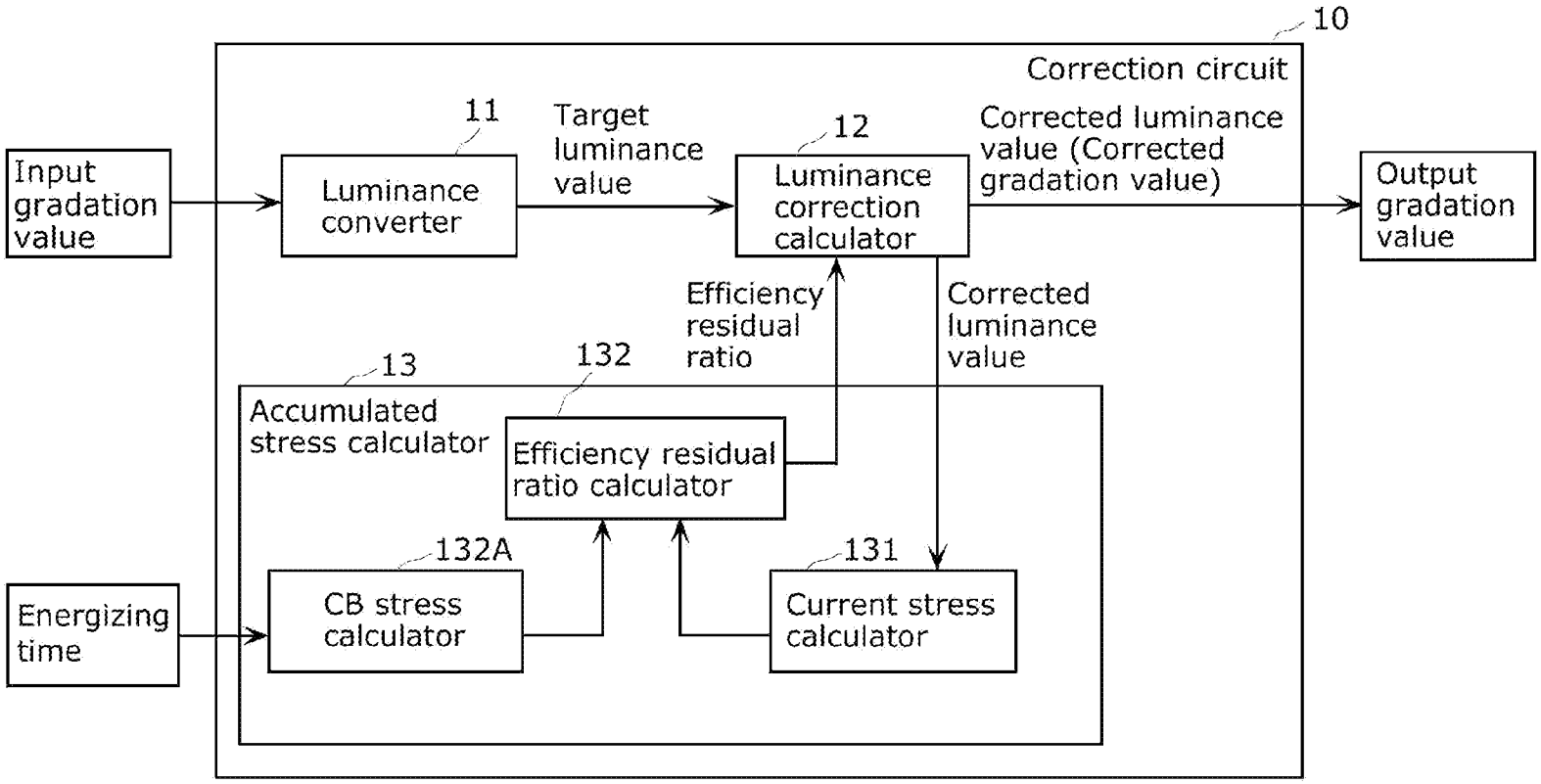
FIG. 11 is a block diagram illustrating another example of a configuration of a correction circuit according to an embodiment.

FIG. 11 is a block diagram illustrating another example of a configuration of correction circuit 10 according to the present embodiment. The same numerical reference is given to elements that are the same as those in FIG. 3 and detailed description thereof shall not be repeated.

Compared to correction circuit 10 illustrated in FIG. 3, correction circuit 10 illustrated in FIG. 11 is different in terms of the configuration of CB stress calculator 132A. Hereinafter, description will be focused on the points that are difference from FIG. 3.

CB stress calculator 132A converts the CB stress amount on light-emitting element 20 into a second stress amount represented by energizing time which indicates the time for which current is supplied to light-emitting element 20, and calculates the accumulated second stress amount obtained by accumulating the second stress amount resulting from the conversion.

In this manner, since the CB stress amount can be evaluated using the time for which current flows through light-emitting element 20 in order to cause light-emitting element 20 to emit light, that is, using the energizing time, the CB stress amount may be converted to a second stress amount represented by the energizing time.

In this case, using the relationship between the luminance of light-emitting element 20 and the accumulated time of the energizing time, efficiency residual ratio calculator 133 calculates a new second efficiency residual ratio attributable to carrier unbalance, from the accumulated time calculated as the accumulated second stress amount.

Figure 12:
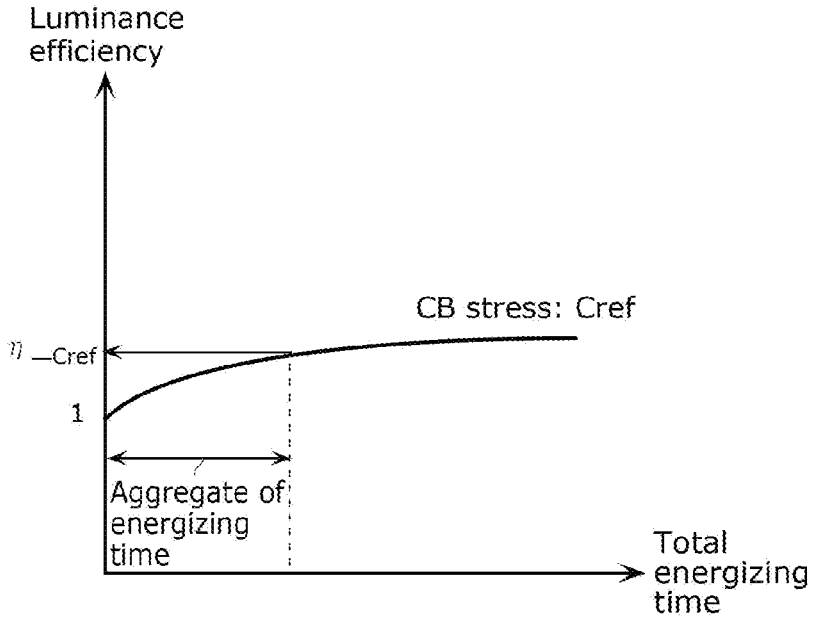
FIG. 12 is a graph illustrating a relationship between the accumulated time of the energizing time of a light-emitting element and the luminance efficiency of the light-emitting element, according to an embodiment.

FIG. 12 is a graph illustrating a relationship between the accumulated time of the energizing time of light-emitting element 20 and the luminance efficiency of light-emitting element 20, according to the present embodiment. FIG. 12 illustrates the relationship when the luminance residual ratio swings up (upswing).

More specifically, using the curve illustrated in FIG. 12, efficiency residual ratio 133 can calculate second efficiency residual ratio $\eta_{_Cref}$ attributable to carrier balance, from the aggregate of the energizing time (accumulated time) calculated by CB stress calculator 132A.

Display device 1 configured in the above-described manner is also capable of reducing display unevenness even in the period of the initial stage of deterioration.

Figure 13:
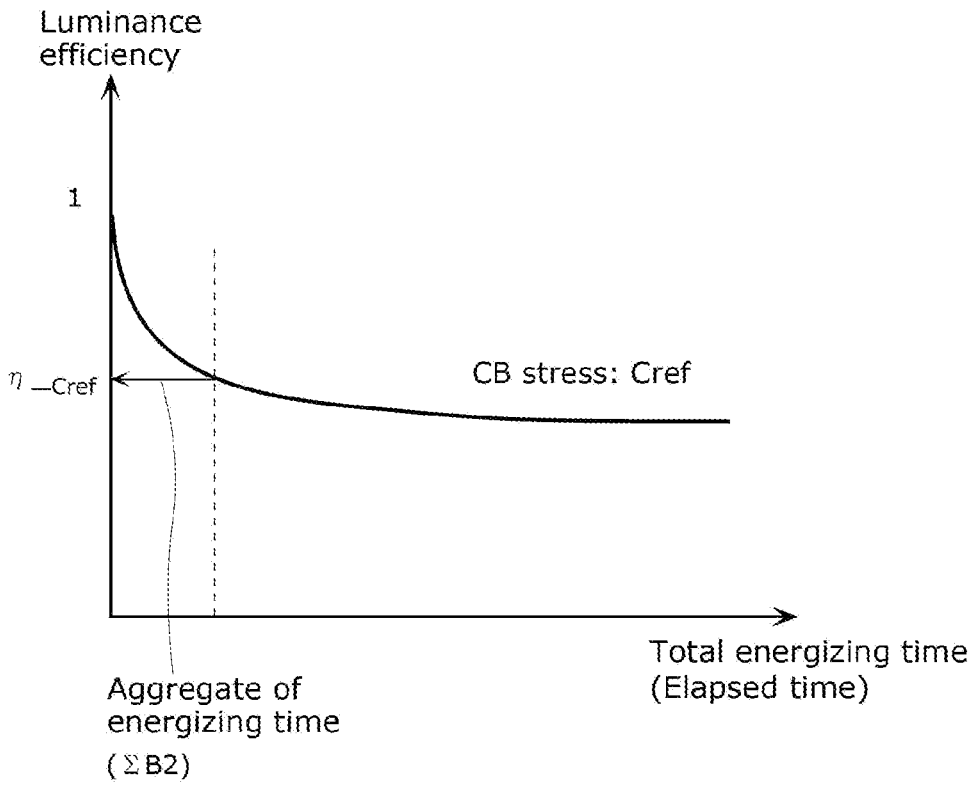
FIG. 13 is a graph illustrating a relationship between the accumulated time of the energizing time of a light-emitting element and the luminance efficiency of the light-emitting element, when luminance residual ratio swings down (downswing), according to an embodiment.

FIG. 13 is a graph illustrating a relationship between the accumulated time of the energizing time of a light-emitting element and the luminance efficiency of the light-emitting element, when luminance residual ratio swings down (downswing), according to an embodiment. In FIG. 13, the accumulated time of the energizing time may be substituted with the elapsed time (accumulated time) when the second reference current flows through light-emitting element 20. Furthermore, the same things as described using FIG. 9B and FIG. 12 can also be said in the case where the luminance residual ratio swings down (downswing). As such, description for the case where the luminance residual ratio swings down will be omitted here.

It should be noted that forms obtained by various modifications to the exemplary embodiment as well forms realized by combining structural components of different exemplary embodiments that may be conceived by those skilled in the art, so long as these do not depart from the essence of the present disclosure are included within the scope of the present disclosure.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure can be used in a display device and a method of driving a display device, and can be used in particular in a display device and a method of driving a display device in the technical field of displays of thin-screen televisions or personal computers having luminescent elements and for which large screens and high resolution are demanded.

The invention claimed is:

1. A display device which includes a display screen in which pixels are arranged in a matrix, each of the pixels including a light-emitting element, the display device comprising:

a correction circuit which corrects an input gradation value indicated by a luminance signal included in a video signal, wherein the correction circuit includes:

a luminance converter which converts the input gradation value into a target luminance value corresponding to the input gradation value;

a correction calculator which calculates an output gradation value from the target luminance value using an efficiency residual ratio which is an index representing a degree of deterioration of the light-emitting element, and calculates a corrected luminance value from the output gradation value, the output gradation value being obtained by correcting the input gradation value, the efficiency residual ratio indicating a residual ratio of light emission efficiency of the light-emitting element, the corrected luminance value being obtained by correcting the target luminance value;

a current stress calculator which converts a current stress amount on the light-emitting element that is calculated from the corrected luminance value into a first stress amount indicating a current stress amount when a first reference current flows through the light-emitting element, and calculates an accumulated first stress amount obtained by accumulating the first stress amount resulting from the conversion;

a carrier balance (CB) stress calculator which converts a CB stress amount, which is a stress amount due to carrier balance, on the light-emitting element into a second stress amount indicating a current stress amount when a second reference current flows through the light-emitting element or a second stress amount represented by an energizing time indicating a time for which current is supplied to the light-emitting element, and calculates an accumulated second stress amount obtained by accumulating the second stress amount resulting from the conversion; and an efficiency residual ratio calculator which updates the efficiency residual ratio, using the accumulated first stress amount and the accumulated second stress amount that are calculated.

2. The display device according to claim 1, wherein the efficiency residual ratio is expressed by a ratio of a light emission luminance of the light-emitting element after deterioration to a light emission luminance of the light-emitting element at an initial stage of operation, and the efficiency residual ratio calculator:

calculates, using a relationship between a luminance of the light-emitting element and an accumulated time for which the first reference current flows through the light-emitting element, a first efficiency residual ratio that is new and attributable to current stress, from the accumulated time which is calculated as the accumulated first stress amount;

calculates, using a relationship between the luminance of the light-emitting element and an accumulated time for which the second reference current flows through the light-emitting element or a relationship between the luminance of the light-emitting element and an accumulated time of the energizing time, a second efficiency residual ratio that is new and attributable to the carrier balance; and updates the efficiency residual ratio by calculating the efficiency residual ratio from the first efficiency residual ratio and the second efficiency residual ratio.

3. The display device according to claim 1, wherein the current stress amount calculated from the corrected luminance value is a stress amount for a first current that flows through the light-emitting element when the light-emitting element is caused to emit light according to the corrected luminance value, the stress amount for the first current is equivalent to a time for which the first current flows through the light-emitting element, a stress amount for the first reference current is equivalent to a time for which the first reference current flows through the light-emitting element, and the current stress calculator converts the current stress amount calculated from the corrected luminance value into the first stress amount by converting the time for which the first current flows through the light-emitting element into the time for which the first reference current flows through the light-emitting element.

4. The display device according to claim 1, wherein when converting the CB stress amount into the second stress amount indicating the current stress amount when the second reference current flows through the light-emitting element:

the CB stress amount is calculated using the corrected luminance value or a time for which current is supplied to the light-emitting element in order to cause the light-emitting element to emit light;

the CB stress amount is equivalent to a time for which a second current flows through the light-emitting element when the light-emitting element is caused to emit light according to the corrected luminance value;

a stress amount for the second reference current is equivalent to a time for which the second reference current flows through the light-emitting element; and the current stress calculator converts the CB stress amount into the second stress amount by converting the time for which the second current flows through the light-emitting element into the time for which the second reference current flows through the light-emitting element.

5. A method of driving a display device which includes a display screen in which pixels are arranged in a matrix, each of the pixels including a light-emitting element, the method comprising:

correcting an input gradation value indicated by a luminance signal included in a video signal, wherein the correcting includes:

converting the input gradation value into a target luminance value corresponding to the input gradation value;

calculating an output gradation value from the target luminance value using an efficiency residual ratio which is an index representing a degree of deterioration of the light-emitting element, and calculating a corrected luminance value from the output gradation value, the output gradation value being obtained by correcting the input gradation value, the efficiency residual ratio indicating a residual ratio of light emission efficiency of the light-emitting element, the corrected luminance value being obtained by correcting the target luminance value;

converting a current stress amount on the light-emitting element that is calculated from the corrected luminance value into a first stress amount indicating a current stress amount when a first reference current flows through the light-emitting element, and calculating an accumulated first stress amount obtained by accumulating the first stress amount resulting from the conversion;

converting a CB stress amount, which is a stress amount due to carrier balance, on the light-emitting element into a second stress amount indicating a current stress amount when a second reference current flows through the light-emitting element, and calculating an accumulated second stress amount obtained by accumulating the second stress amount resulting from the conversion; and updating the efficiency residual ratio, using the accumulated first stress amount and the accumulated second stress amount that were calculated.

6. The method according to claim 5, wherein the efficiency residual ratio is expressed by a ratio of a light emission luminance of the light-emitting element after deterioration to a light emission luminance of the light-emitting element at an initial stage of operation, and the updating of the efficiency residual ratio includes:

calculating, using a relationship between a luminance of the light-emitting element and an accumulated time for which the first reference current flows through the light-emitting element, a first efficiency residual ratio that is new and attributable to current stress, from the accumulated time which is calculated as the accumulated first stress amount;

calculating, using a relationship between the luminance of the light-emitting element and an accumulated time for which the second reference current flows through the light-emitting element or a relationship between the luminance of the light-emitting element and an accumulated time of the energizing time, a second efficiency residual ratio that is new and attributable to the carrier balance; and updating the efficiency residual ratio by calculating the efficiency residual ratio from the first efficiency residual ratio and the second efficiency residual ratio.

7. The method according to claim 5, wherein the current stress amount calculated from the corrected luminance value is a stress amount for a first current that flows through the light-emitting element when the light-emitting element is caused to emit light according to the corrected luminance value, the stress amount for the first current is equivalent to a time for which the first current flows through the light-emitting element, a stress amount for the first reference current is equivalent to a time for which the first reference current flows through the light-emitting element, and the converting of the current stress includes converting the current stress amount calculated from the corrected luminance value into the first stress amount by converting the time for which the first current flows through the light-emitting element into the time for which the first reference current flows through the light-emitting element.

8. The method according to claim 5, wherein when converting the CB stress amount into the second stress amount indicating the current stress amount when the second reference current flows through the light-emitting element:

the CB stress amount is calculated using the corrected luminance value or a time for which current is supplied to the light-emitting element in order to cause the light-emitting element to emit light;

the CB stress amount is equivalent to a time for which a second current flows through the light-emitting element when the light-emitting element is caused to emit light according to the corrected luminance value;

a stress amount for the second reference current is equivalent to a time for which the second reference current flows through the light-emitting element; and the converting of the CB stress amount includes converting the CB stress amount into the second stress amount by converting the time for which the second current flows through the light-emitting element into the time for which the second reference current flows through the light-emitting element.

* * * * *